US007036694B2

(12) United States Patent
Smalls

(10) Patent No.: US 7,036,694 B2
(45) Date of Patent: May 2, 2006

(54) SCENTED TIE INSERT AND METHOD THEREFOR

(76) Inventor: Samuel L. Smalls, 11909 Wimbleton St., Upper Marlboro, MD (US) 20774

( * ) Notice: Subject to any disclaimer, the term of this patent is extended or adjusted under 35 U.S.C. 154(b) by 456 days.

(21) Appl. No.: 10/420,393

(22) Filed: Apr. 23, 2003

(65) Prior Publication Data

US 2004/0210977 A1 Oct. 28, 2004

(51) Int. Cl.
*D06C 15/00* (2006.01)

(52) U.S. Cl. ..... 223/82

(58) Field of Classification Search ..... 223/1, 223/49, 34, 81, 82, 83, 84
See application file for complete search history.

(56) References Cited

U.S. PATENT DOCUMENTS

| | | | |
|---|---|---|---|
| 517,769 | A | 4/1894 | Selowsky |
| 1,202,717 | A | 10/1916 | Hey |
| 1,373,065 | A | 3/1921 | Forman |
| 2,174,966 | A | 10/1939 | Campagnoli |
| 3,744,057 | A | 7/1973 | Luceri |
| RE30,950 | E | 6/1982 | Ackerman |
| 5,377,883 | A | 1/1995 | Melton et al. |
| 5,575,007 | A | 11/1996 | Gaffney |

FOREIGN PATENT DOCUMENTS

| | | | |
|---|---|---|---|
| DE | 1952290 | A1 * | 1/1997 |
| EP | 0643932 | A1 * | 8/1994 |
| FR | 2593962 | * | 2/1987 |
| GB | 2232060 | A * | 12/1999 |
| JP | 364504 | * | 3/1991 |

* cited by examiner

*Primary Examiner*—Danny Worrell
(74) *Attorney, Agent, or Firm*—Jeffrey Weiss; Harry M. Weiss; Weiss, Moy & Harris, P.C.

(57) ABSTRACT

A scented tie insert and method therefor capable of retaining a fragrance and being inserted into a tie, either a necktie or a bowtie. This device allows a person to have a fragrance without having the fragrance coming into contact with the person's skin or other clothing.

12 Claims, 2 Drawing Sheets

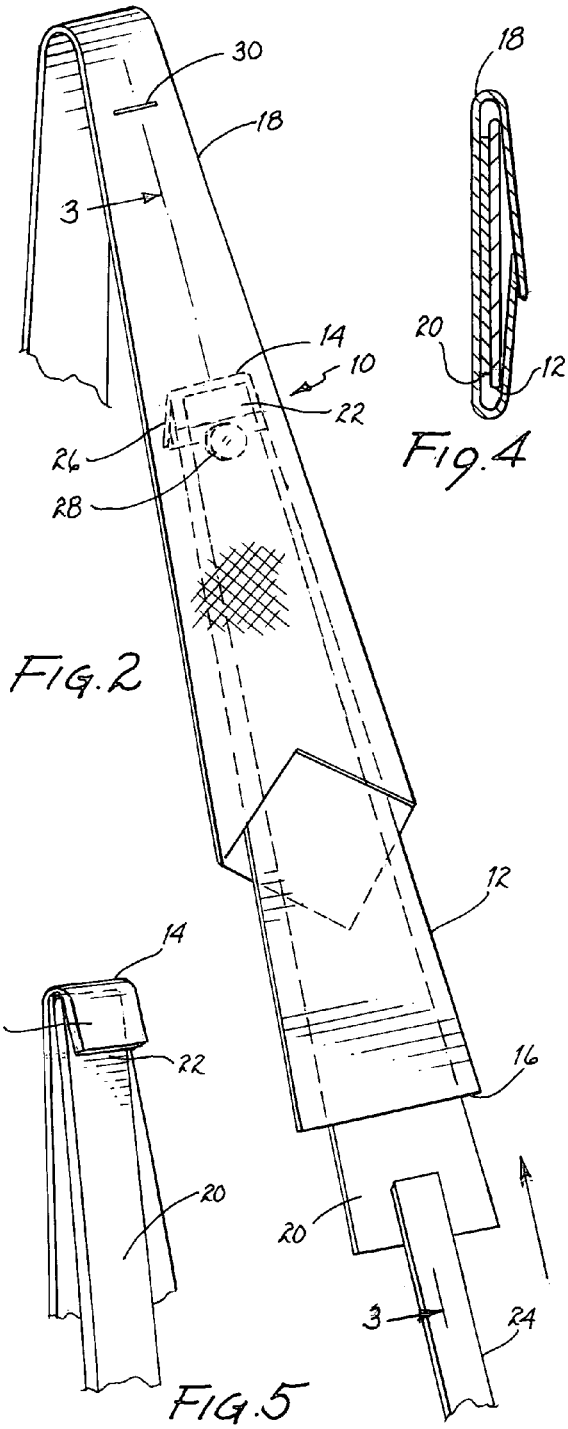
FIG. 2
FIG. 4
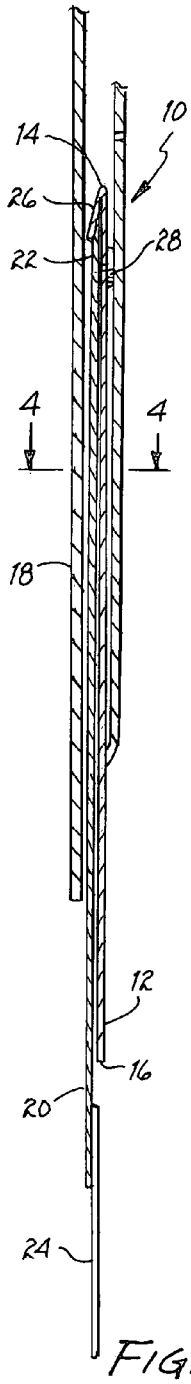
FIG. 3
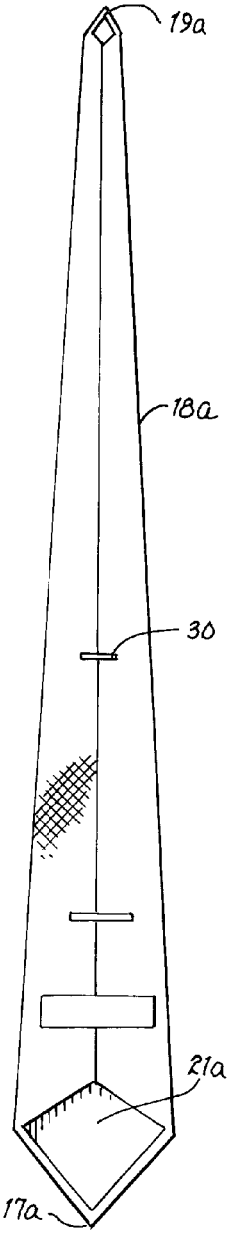
FIG. 1
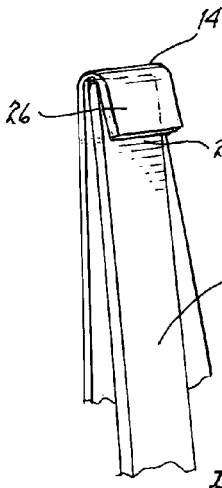
FIG. 5

SCENTED TIE INSERT AND METHOD THEREFOR

FIELD OF THE INVENTION

This invention relates generally to ties and bowties and, more specifically, to a scented tie insert dimensioned to be inserted into a tie. In this way, those who wish to wear cologne or perfume could do so without applying any fragrance to their skin, but rather by applying a fragrance to a tie insert, which could then be inserted into a tie.

BACKGROUND OF THE INVENTION

Ties, both neckties and bowties, are an essential component of formal attire. Even those who dress casually often choose to wear either a necktie or a bowtie. A common supplement to a person's attire comes in the form of cologne, aftershave, and other fragrances. Usually, a fragrance is sprayed or otherwise applied to the skin of the person, often to the neck and face.

Many people have allergic reactions to fragrances that come into contact with their skin. The handling of cologne, or other fragrances, by such individuals therefore presents health concerns.

In addition, fragrances such as cologne are often quite expensive. People often limit their choice to one type of fragrance because the cost of purchasing more than one variety is prohibitive.

A need therefore existed for a device and method that would permit a user to utilize a fragrance, without the need for bringing that fragrance directly into contact with the skin. Specifically, a need existed for a tie insert capable of retaining a fragrance and dimensioned to be inserted into a tie in order to allow a person to give off a fragrance without the fragrance coming into contact with the person's skin or shirt. A variety of scented tie inserts would also allow a person to emit a variety of fragrances without the need to purchase multiple bottles of expensive colognes and other fragrances.

SUMMARY OF THE INVENTION

An object of the present invention is to provide a scented tie insert capable of being inserted into a tie in order to provide a tie with a fragrance.

It is a further object of the present invention to provide a method for wearing a scented tie capable of allowing a person to have a fragrance without applying that fragrance directly to their skin or shirt.

BRIEF DESCRIPTION OF THE PREFERRED EMBODIMENTS

In accordance with one embodiment of the present invention, a scented tie insert device is disclosed, comprising a tie insert having a first end and a second end and dimensioned to be inserted into a tie, the tie insert being adapted to retain a fragrance.

In accordance with another embodiment of the present invention, a scented necktie insert device is disclosed, comprising, in combination a necktie having a first end and a second end and tapered in width from wide to narrow from the first end to the second end, the necktie defines a substantially flat cavity between the first end and the second end, and a necktie insert having a first end and a second end and dimensioned to be inserted into the cavity of the necktie, the necktie insert being adapted to retain a fragrance.

In accordance with yet another embodiment of the present invention, a scented bowtie insert device is disclosed, comprising, in combination a bowtie having a first end portion and a second end portion, at least one of the first end portion of the bowtie and the second end portion of the bowtie defines a substantially flat cavity, and at least one bowtie insert having a first end and a second end and dimensioned to be inserted into at least one of the cavity of the first end portion of the bowtie and the second end portion of the bowtie, the bowtie insert being adapted to retain a fragrance.

In accordance with still embodiment of the present invention, a method for wearing a scented tie is disclosed, comprising, in combination, the steps of providing a tie insert having a first end and a second end and dimensioned to be inserted into a tie, applying a fragrance to the tie insert, and inserting the tie insert into a tie.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

FIG. 1 is a back view of the necktie of the scented necktie insert device of the present invention.

FIG. 2 is a perspective view of the preferred embodiment of the scented tie insert device of the present invention, showing the rigid insertion member driving the tie insert into the necktie.

FIG. 3 is a side, cross-sectional view of the scented tie insert device of FIG. 2, taken along line 3—3.

FIG. 4 is a top, cross-sectional view of the scented tie insert device of FIG. 3, taken along line 4—4.

FIG. 5 is a perspective view of the preferred embodiment of the scented tie insert device of FIG. 4, showing a first end of the tie insert having a pocket which is receiving the first end of the rigid insertion member.

DETAILED DESCRIPTION OF THE PREFERRED EMBODIMENTS

Figures 6, 7, 8, 9, 10, 11, 12:
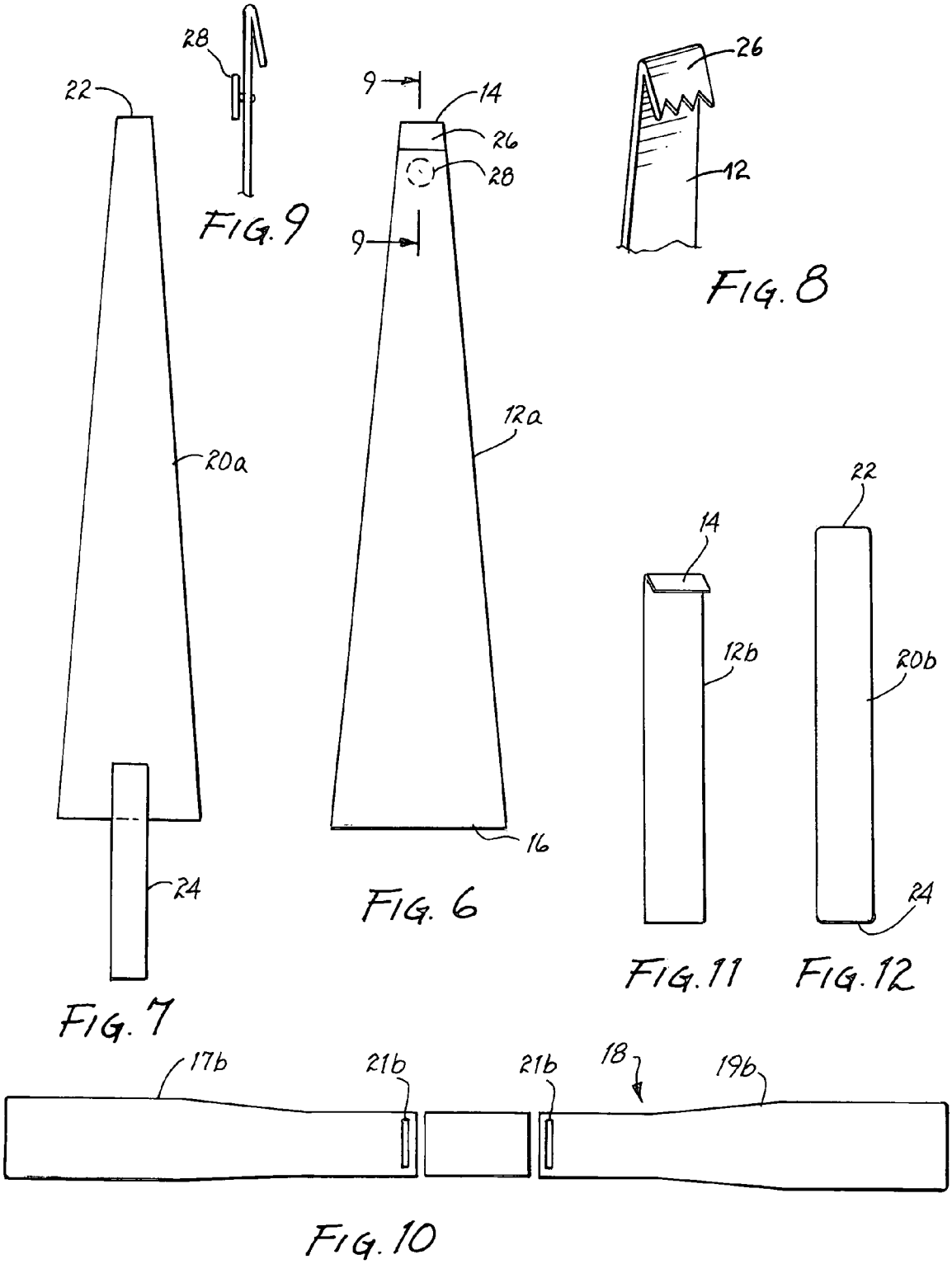
FIG. 6 is a back view of the tie insert of the present invention.
FIG. 7 is a back view of the rigid insertion member of the present invention.
FIG. 8 is a perspective view of the first end of a tie insert, showing a pocket dimensioned to receive the first end of the rigid insertion member.
FIG. 9 is a side view of the first end of the tie insert of FIG. 6, taken along line 9—9., and showing a button used to couple the tie insert to the tie.
FIG. 10 is a front view of the first end portion and second end portion of a bowtie.
FIG. 11 is a front view of the bowtie insert of the scented bowtie insert device of the present invention.
FIG. 12 is a front view of the rigid insertion member used to insert the bowtie insert into a bowtie.

Referring to FIGS. 2–3, the preferred embodiment of the scented tie insert device, hereinafter scented tie insert device 10, is shown. The scented tie insert device 10 comprises a tie insert 12 having a first end 14 and a second end 16. The tie insert 12 is dimensioned to be inserted into a tie 18. The tie insert 12 is adapted to retain a fragrance. It is understood that fragrance includes cologne, perfume, medicinal-type sprays, bug-repellant, or other odor which a person might otherwise have to apply to the skin or clothing.

In one embodiment of the scented tie insert device 10, the tie 18 is a necktie 18*a* (shown in FIG. 1) and the tie insert 12 is a necktie insert 12*a* (shown in FIG. 6) dimensioned to be inserted into the necktie 18*a*. Preferably, the necktie 18*a* has a first end 17*a* (shown in FIG. 1) and a second end 19*a* (shown in FIG. 2) and is tapered in width from wide to narrow from the first end 17 to the second end 19. The necktie 18*a* preferably defines a substantially flat cavity 21*a* (shown in FIG. 1) between the first end 17 and the second end 19. It is in this cavity 21 that the necktie insert 12*a* is inserted. In this embodiment, the scented necktie insert device 10 preferably further comprises a button 28 (shown in FIGS. 2, 3, 6 and 9) coupled to the necktie insert 12*a*. The button 28 is dimensioned to couple the necktie insert 12*a* to the necktie 18*a* through an aperture 30 (shown in FIGS. 1–2) defined by the necktie 18*a*.

While, in this embodiment, a button 28 is coupled to the necktie insert 12*a* and is dimensioned to be coupled the necktie insert 12*a* through an aperture 30 defined by the necktie 18*a*, it should be clearly understood that substantial benefit could be derived from an alternative embodiment of the scented tie insert device 10 in which there is an alternative means for coupling the necktie insert 12*a* to the necktie 18*a*. For example, another coupling method could involve positioning a button on a necktie 18 and a mating aperture on a necktie insert 12. Still further, it would be possible to position hook material on one of the insert 12 and cavity 21, and mating loop material on the other of the insert 12 and cavity 21, to permit coupling of the insert 12 to the cavity 21.

In one embodiment of the scented tie insert device 10, the tie insert 12 is dimensioned to be retained by the tie 18 by means of frictional engagement. In such an embodiment, the tie insert 12 is made of a material capable of being inserted into the tie 18 while at the same time the tie insert 12 is capable of being retained by the tie 18 so that gravity alone is not sufficient to remove the tie insert 12 form the tie 18.

Referring now to FIGS. 10–11, in another embodiment of the scented tie insert device 10, the tie 18 is a bowtie 18*b* (shown in FIG. 10) and the tie insert 12 is a bowtie insert 12*b* (shown in FIG. 11) dimensioned to be inserted into the bowtie 18*b*. Preferably, the bowtie 18*b* has a first end portion 17*b* and a second end portion 17*b*. At least one of the first end portion 17*b* and the second end portion 19*b* preferably define a substantially flat cavity 21*b* dimensioned to receive at least one bowtie insert 12*b*.

Referring now to FIGS. 2–5, the scented tie insert device 10 preferably further comprises a substantially rigid insertion member 20 having a first end 22 dimensioned to be detachably coupled to the first end 14 of the tie insert 12. The insertion member 20 preferably also comprises a second end 24 (shown in FIGS. 2–3) dimensioned to be gripped by a person (not shown). The insertion member 20 is preferably dimensioned to insert the tie insert 12 into the tie 18 when the first end 22 of the insertion member 20 drives the first end 14 of the tie insert 12 into the tie 18. Preferably, the first end 14 of the tie insert 12 comprises a pocket 26 (shown in FIGS. 2, 3 and 5) dimensioned to receive the first end 22 of the insertion member 20, although it should be clearly understood that substantial benefit could be derived from an alternative configuration of the scented tie insert device 10 in which the tie insert 12 does not comprises a pocket 26 so long as the insertion member 20 is able to drive the tie insert 12 into the tie 18.

Referring now to FIGS. 1, 6 and 7, in one embodiment, the substantially rigid insertion member 20 is a substantially rigid insertion member 20*a* dimensioned to couple to the necktie insert 12*a* and drive it into the necktie 18*a*. Referring now to FIGS. 10–12, in another embodiment, at least one substantially rigid insertion member 20*b* is dimensioned to couple to at least one bowtie insert 12*b* and drive it into the bowtie 18*b*.

While, in the preferred embodiment, the scented tie insert device 10 comprises a substantially rigid insertion member 20, it should be clearly understood that substantial benefit could be derived from an alternative configuration of the scented tie insert device 10 which does not comprise an insertion member 20 so long as the tie insert 12 can be inserted into the tie 18, such as by pushing it in by hand.

While the invention has been particularly shown and described with reference to preferred embodiments thereof, it will be understood by those skilled in the art that the foregoing and other changes in form and details may be made therein without departing from the spirit and scope of the invention.

I claim:

1. The A scented tie insert device comprising, in combination:

a tie insert having a first end and a second end and dimensioned to be inserted into a tie, said tie insert being adapted to retain a fragrance; and a substantially rigid insertion member having a first end dimensioned to be detachably coupled to said first end of said tie insert and a second end dimensioned to be gripped by a person, said insertion member being dimensioned to insert said tie insert into said tie when said first end of said insertion member drives said first end of said tie insert into said tie.

2. The scented tie insert device of claim 1 wherein said first end of said tie insert comprises a pocket dimensioned to receive said first end of said insertion member.

3. A scented necktie insert device comprising, in combination:

a necktie having a first end and a second end and tapered in width from wide to narrow from said first end to said second end, and including an elongated portion having said-necktie defines a substantially flat and elongated cavity therein and said second; and a flat and elongated necktie insert having a first end and a second end and dimensioned to be inserted into said substantially flat and elongated cavity within said elongated portion of said necktie, said necktie insert being adapted to retain a fragrance.

4. The necktie insert device of claim 3 further comprising a button coupled to said necktie inset, said button being dimensioned to couple said necktie inset to said necktie through an aperture defined by said necktie.

5. The A scented necktie insert device comprising, in combination:

a necktie having a first end and a second end and tapered in width from wide to narrow from said first end to said second end, said necktie defines a substantially flat cavity between said first end and said second end;

a necktie insert having a first end and a second end and dimensioned to be inserted into said cavity of said necktie, said necktie insert being adapted to retain a fragrance; and a substantially rigid insertion member having a first end dimensioned to be detachably coupled to said first end of said necktie insert and a second end dimensioned to be gripped by a person, said insertion member being dimensioned to insert said necktie insert into said necktie when said first end of said insertion member drives said first end of said necktie insert into said necktie.

6. The necktie insert device of claim 5 wherein said first end of said necktie insert comprises a pocket dimensioned to receive said first end of said insertion member.

7. The A scented bowtie insert device comprising, in combination:

a bowtie having a first end portion and a second end portion, at least one of said first end portion of said bowtie and said second end portion of said bowtie defines a substantially flat cavity;

at least one bowtie insert having a first end and a second end and dimensioned to be inserted into at least one of said cavity of said first end portion of said bowtie and said second end portion of said bowtie, said bowtie insert being adapted to retain a fragrance; and a substantially rigid insertion member having a first end dimensioned to be detachably coupled to said first end of said bowtie insert and a second end dimensioned to be gripped by a person, said insertion member being dimensioned to insert said bowtie insert into said bowtie when said first end of said insertion member drives said first end of said bowtie insert into said bowtie.

8. A method for wearing a scented necktie comprising, in combination the steps of:

providing a flat and elongated tie insert having a first end and a second end and dimensioned to be inserted into a substantially flat and elongated cavity within an elongated portion of a necktie;

applying a fragrance to said necktie insert; and inserting said necktie insert into said cavity.

9. The method of claim 8 wherein said tie insert being dimensioned to be retained by said tie by means of frictional engagement.

10. A method for wearing a scented tie comprising in combination the steps of:

providing a tie insert having a first end and a second end and dimensioned to be inserted into a tie;

providing a substantially rigid insertion member having a first end dimensioned to be detachably coupled to said first end of said tie insert and a second end dimensioned to be gripped by a person, said insertion member being dimensioned to insert said tie insert into said tie when said first end of said insertion member drives said first end of said tie insert into said tie;

applying a fragrance to said tie insert; and inserting said tie insert into a tie.

11. The method of claim 8 wherein said first end of said tie insert comprises a pocket dimensioned to receive said first end of said insertion member.

12. The method of claim 8 further comprising a button coupled to said tie insert, said button being dimensioned to couple said tie insert to said tie through an aperture defined by said tie.

* * * * *